US005193651A

United States Patent [19]

Shigeta et al.

[11] Patent Number: 5,193,651

[45] Date of Patent: Mar. 16, 1993

[54] ELEVATOR APPARATUS

[75] Inventors: Masayuki Shigeta, Katsuta; Tadashi Shibata, Ibaraki; Jun Sugahara; Toshihiko Nara, both of Katsuta; Kiyoyasu Mitsumori, Hitachi, all of Japan

[73] Assignee: Hitachi, Ltd., Tokyo, Japan

[21] Appl. No.: 757,210

[22] Filed: Sep. 10, 1991

[30] Foreign Application Priority Data

Sep. 10, 1990 [JP] Japan ..... 2-237170

[51] Int. Cl.[5] ..... B66B 7/02

[52] U.S. Cl. ..... 187/95; 187/26

[58] Field of Search ..... 187/26, 95

[56] References Cited

U.S. PATENT DOCUMENTS

| | | | |
|---|---|---|---|
| 2,277,565 | 3/1942 | Spiro | 187/95 |
| 3,061,047 | 10/1962 | Gunning | 187/95 |
| 3,087,583 | 4/1963 | Bruns | 187/95 |
| 3,099,334 | 7/1963 | Tucker | 187/95 |
| 3,338,336 | 8/1967 | Lodige | 187/95 |
| 3,669,222 | 6/1972 | Takamura et al. | 187/95 |
| 3,905,452 | 9/1975 | Schirmer | 187/95 X |
| 4,754,849 | 7/1988 | Ando | 187/95 |
| 5,086,882 | 2/1992 | Sugahara et al. | 187/95 |

*Primary Examiner*—Robert P. Olszewski

*Assistant Examiner*—Dean Reichard

*Attorney, Agent, or Firm*—Antonelli, Terry, Stout & Kraus

[57] ABSTRACT

An elevator apparatus includes guide devices having guide members engaged with a pair of guide rails so as to guide a car along the guide rails in a manner to hold the car in a proper position. Each of the guide devices includes a resilient support member having a small spring constant supporting the guide member in such a manner that the guide member is movable in a direction perpendicular to a plane of the guide rail. An axis of suspension of the car is deviated from a position of a center of gravity of the car so as to cause a guide load, acting on a side surface of the guide rail via the guide member in a direction perpendicular to the plane of the guide rail, to have a deflected load acting on the guide rail in one direction. The guide device further includes an anti-deflected load generating device for generating an anti-deflected load in a direction to reduce a deflected load component of the guide load produced by the above deviation. With this arrangement, a lateral vibration of the car, which would be caused by an inherent bending of the guide rail, or a bending of the guide rail due to an error in installation of the guide rail or aging, is prevented.

16 Claims, 4 Drawing Sheets

ELEVATOR APPARATUS

BACKGROUND OF THE INVENTION

This invention relates to an elevator apparatus, and more particularly to an elevator apparatus provided with a guide device which can guide a car without shaking or vibrating it.

Generally, a car of an elevator is guided along a pair of guide rails by guide devices comprising guide slide members and guide rollers, and is driven to run in such a manner as to be held horizontally. At this time, the position of the center of gravity of the car during operation varies in accordance with the distribution of a live load in the car and the distribution of weights of cables for supplying electric power to the car, a compensation rope, etc., which weights vary with time, so that this center of gravity position does not coincide with the axis of suspension of the car. Therefore, the car guide devices, while receiving deflected loads of the car resulting from the deviation of the car suspension axis from its center of gravity position, guide the car.

If the guide rail is bent at a portion thereof, the car is subjected to a forcible excitation or vibration due to this bending through the guide devices. In order to reduce a lateral vibration of the car due to this forcible excitation, the guide device usually guides the car through guide members in the form of a resilient support member such as a spring, a rubber member or the like.

In order to prevent the lateral vibration of the car due to the above-mentioned bending of the guide rail, it is desired to reduce the elastic constant of the resilient support member; however, in order to keep the flexure due to the deflected load of the car to within a predetermined range so as to guide the car safely, the guide member is required to have a predetermined rigidity.

The prior art satisfying the above two functions required for the guide device for the elevator apparatus includes, for example, Japanese Patent Publication No. 58-39753 and Japanese Unexamined Patent Publication No. 63-87482.

These prior art techniques are directed to a system in which guide portions of a magnetic guide type are used to guide a car in a non-contact manner.

Another example of the prior art is known from Japanese Unexamined Patent Publication No. 58-104885. In this prior art, the axis of suspension of a car is deviated from the position of its center of gravity toward an entrance-exit of the car, and guide devices guide the car in a manner to urge the car against guide rails, thereby preventing a lateral vibration of the car.

In the above prior art technique using the magnetic guide system (Japanese Patent Publication No. 58-39753 and Japanese Unexamined Patent Publication No. 63-87482), magnetic controllers are required respectively for the guide devices provided in the rail gauge direction of a pair of guide rails and on opposite sides of a plane in which the guide rails are disposed. A displacement of the car due to a bending of the guide rail is detected based on a reference line extending from an uppermost stair to a lowermost stair, thereby controlling the position of the car relative to the guide rails. Therefore, this system is quite expensive, and therefore has a problem that it is not easily applied to ordinary elevators.

In the above prior art (Japanese Unexamined Patent Publication No. 58-104885) in which the suspension axis of the car is deviated from the position of its center of gravity toward the entrance/exit of the car, there is encountered a problem that vibration of the car due to a bending of the guide rail can not be prevented.

SUMMARY OF THE INVENTION

With the above problems of the prior art in view, it is an object of the present invention to provide an elevator apparatus in which a deflected load acting on a guide device for a car is effectively reduced, and a lateral vibration of the car due to a bending of the guide rail due to an error in installation of a guide rail or aging can be prevented, thereby preventing passengers of the elevator from feeling uneasy.

Another object of the invention is to provide an elevator apparatus in which a good ride of the elevator can be provided even if a deflected load is produced in the elevator apparatus.

A further object of the invention is to provide a elevator apparatus in which a slight bending of a guide rail produced during the installation thereof can be allowed, thereby enabling an efficient and practical installation of the elevator.

The above objects of the present invention have been achieved by the provision of anti-deflected load generating devices on a car which devices reduce deflected loads developing in guide devices and by making small the elastic constant of resilient support members for guide members of the guide devices.

The anti-deflected load generating device can be constituted by magnet means or pneumatic bearing means.

The number of the anti-deflected load generating means can be reduced by deviating the suspension axis of the car from the position of its center of gravity, so that the anti-deflected load generating means reduces only the load acting on the guide member disposed on one side of the guide rail.

In the prior art, the resilient member for supporting the guide member of the guide device is required to have sufficient spring constant to withstand the deflected load acting on the car. In the present invention, however, since the anti-deflected load generating devices for reducing the deflected loads are used a resilient member having a small spring constant can be used. As a result, in the present invention, a forcible excitation of the car due to a bending of the guide rail can be made small, thereby providing the elevator apparatus capable of offering a good ride.

The anti-deflected load generating device can be constituted by a magnet or a pneumatic bearing. By deviating the suspension axis of the car from the position of its gravity center, the deflected load acts only on the guide member disposed on one side of the guide rail. Therefore, it is only necessary to reduce the deflected load acting on this guide member disposed on the one side of the guide rail, so that the number of the anti-deflected load generating devices can be reduced.

In the present invention, since the suspension axis of the car is deviated from the position of its center of gravity, it is possible to use a hoisting device having no deflector wheel, and the invention can be applied to an elevator of the hydraulic jack suspension type in which the car is suspended at a position rearwardly of a rear portion of the car remote from its entrance/exit.

DESCRIPTION OF THE PREFERRED EMBODIMENTS

A preferred embodiment of the present invention will now be described with reference to the drawings.

Figure 1:
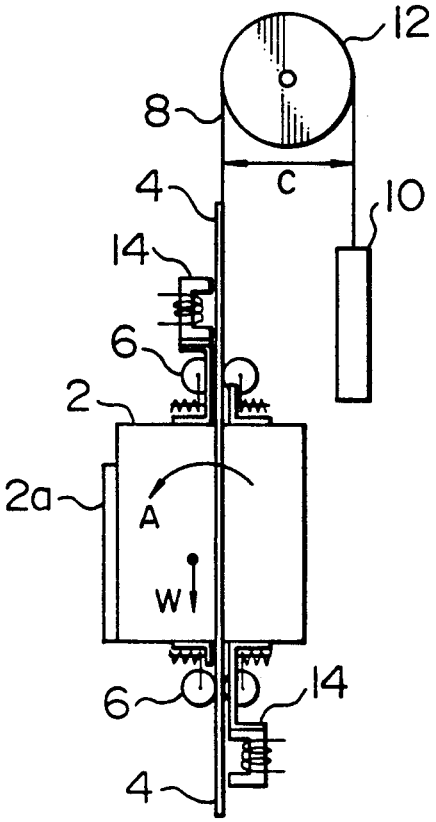
FIG. 1 is a side elevational view of a first embodiment of the present invention.
Figure 2:
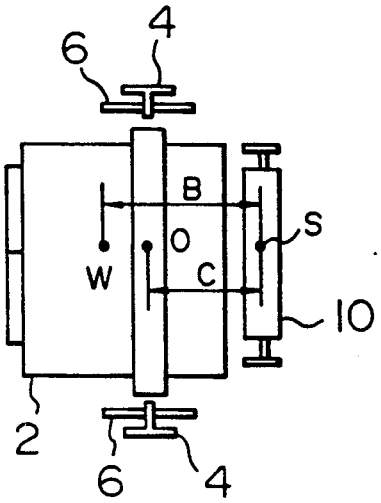
FIG. 2 is a plan view of this embodiment.
Figure 3:
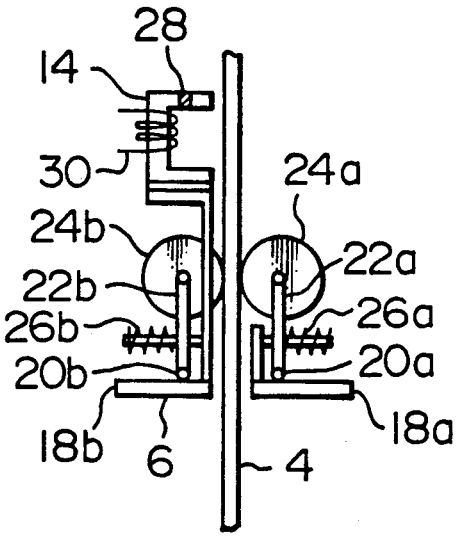
FIG. 3 is a side elevational view showing an anti-deflected load generating device.

In FIGS. 1 to 3, reference numeral 2 denotes a car (cage), reference numeral 4 a guide rail, reference numeral 6 a guide device, reference numeral 8 a rope, reference numeral 10 a counterweight, reference numeral 12 a drive pulley (sheave), and reference numeral 14 an electromagnet.

In the embodiment of the present invention shown in FIGS. 1 and 2, the car 2 is guided by a pair of guide rails 4 and the guide devices 6 engaged with the guide rails 4. The car 2 and the counterweight 10 are fixedly secured to the opposite ends of the rope 8, respectively. The rope 8, extended around the sheave 12 of a hoisting device, is driven by the rotating sheave 12 to move the car 2 upward and downward.

The axis O of suspension of the car 2 is deviated from the position W of the center of gravity of the car 2 toward the side of the counterweight 10. As a result, the car 2 tends to tilt or angularly move in a direction A toward an entrance/exit 2*a* of the car 2. The guide devices 6 support deflected (unbalanced) loads due to the tilting of the car 2, and guide the car 2.

At this time, the guide devices 6 guide the car 2 in such a manner that the guide load, applied to one side surface of each of the pair of guide rails 4 via a guide member (roller) 24*b* (FIG. 3) in a direction perpendicular to the plane of the guide rail 4, is unbalanced (deflected) with the guide load acting on the other side surface of the guide rail 4. Each of the guide devices 6, mounted respectively on the upper and lower portions of the car 2, has an anti-deflected load generating device which comprises an electromagnet (magnet) 14 for attracting the guide rail 4 in such a direction as to reduce the deflected component of the guide load.

As best shown in FIG. 3 (which shows the guide device 6 mounted on the upper portion of the car 2), the guide device 6 comprises arms 22*a* and 22*b* pivotally mounted at their one ends on bases 18*a* and 18*b* by pins 20*a* and 20*b*, respectively, rollers 24*a* and 24*b* supported respectively on the distal ends of the arms 22*a* and 22*b*, and roller support springs 26*a* and 26*b* urging the rollers 24*a* and 24*b* against the opposite side surfaces of the guide rail 4, respectively. The car 2 is guided by the rollers 24*a* and 24*b* to be moved along the guide rail 4.

The guide device 6 also includes the anti-deflected load generating device which comprises the magnet 14 and serves to cancel the deflected load developing in the construction of the present invention, as later described. This device cancels the deflected load, so that the car 2 can be guided without receiving vibrations. More specifically, the anti-defected load generating device attracts the guide rail 4 by the magnet 14, and this attraction force serves to angularly move the car 2 (on which the guide devices 6 each provided with the anti-deflected load generating device (the magnet 14) are mounted) in a direction opposite to the direction A (FIG. 1) so as to cancel the above-mentioned deflected load. The magnet 14 may be an electromagnet or a permanent magnet, as later described, and also may be constituted by a combination of the two.

Here, assuming that the axis 0 of suspension of the car 2 is deviated from the position W of the center of gravity of the car 2 as shown in FIG. 2, the roller support spring 26*a* is compressed (FIG. 3), and the roller support spring 26*b* becomes longer than the roller support spring 26*a*. As a result, the base 18*a* comes closer to the guide rail 4. Therefore, each of the roller support springs 26*a* and 26*b* is required to have a predetermined rigidity acting against expected deflected loads so that the bases 18*a* and 18*b*, a brake member (not shown) mounted on the car 2 for stopping the car 2 in the event of an emergency, etc., may not contact the side surfaces of the guide rail 4.

Therefore, if the guide rail 4 is bent at a portion thereof, the rollers 24*a* and 24*b* are displaced in an amount corresponding to the amount of this bending, and a force, corresponding to a force ($P=krSr$), obtained by multiplying the amount Sr of displacement of the rollers 24*a* and 24*b* relative to the bases 18*a* and 18*b* by a spring constant kr (which is the resultant of the spring constants of the roller support springs 26*a* and 26*b*), serves as an exciting force acting on the car 2 in its lateral direction, so that the car 2 is vibrated or shaken in its lateral direction.

Figure 4:
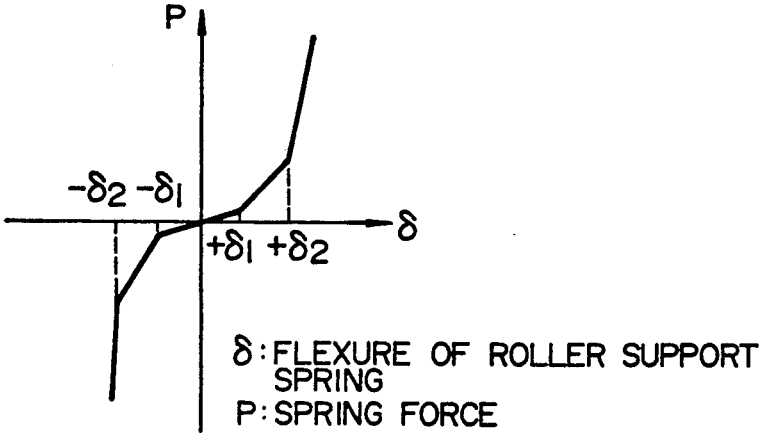
FIG. 4 is a graph showing the relation between the amount of flexure of a roller support spring and a spring force.

With respect to the flexure-load characteristics of the roller support springs 26*a* and 26*b*, if the spring constant kr is small when the flexure amount is in the range of $-\delta_1$ to $+\delta_1$ around the central set value of the guide device 6, as shown in FIG. 4, the exciting force P causing the lateral vibration can be made sufficiently small, and a slight bending of the guide rail 4 can be allowed.

To achieve this, it is necessary that the deflected components of the guide loads acting on the rollers (guide members) 24*a* and 24*b* should be reduced.

On the other hand, these deflected load components vary with a change in the center of gravity of the car 2 which change is caused by the distribution of a live load on the car 2 and a fluctuating load of tail cords (not shown) for supplying electric power to the car 2. Therefore, even if the axis of suspension of the car 2 is set in agreement with the static center of gravity of the car 2 determined by the structure of the car 2, the guide loads acting on the rollers 24*a* and 24*b* would be varied.

In order to control the variation of the guide loads by the electromagnets in the prior art discussed above, it is necessary that the electromagnets be provided respectively on both side surfaces of the guide rail so as to achieve this control even when the deflected load acts in either of the direction A (FIG. 1) and the direction opposite thereto.

In the embodiment of the present invention, however, since the axis O of suspension of the car 2 is deviated from the center of gravity position W of the car 2, one of the guide loads acting respectively on the rollers 24*a* and 24*b* is always greater. Therefore, by reducing the deflected load component of the greater guide load by means of the electromagnet 14, the deflection (unbalance) of the guide loads acting on the rollers 24*a* and 24*b* can be prevented.

As a result, in the embodiment of the present invention, the number of the electromagnets for controlling the deflected loads can be reduced to a half (½) of that heretofore required, and the deflected load control can be achieved at lower costs. And besides, since the deflected load is reduced by the anti-deflected load generating device, the displacement of the guide device is reduced, so that the spring constant kr of the roller support springs can be reduced. Therefore, the forcible exciting force acting on the car 2 in its lateral direction due to the bending of the guide rail can be reduced, so that the lateral vibration of the car 2 can be prevented.

Incidentally, the spring constant kr of the roller support springs should preferably be large when the amount of flexure of the spring is above an appropriate value of $\delta_2$, as shown in FIG. 4, so as to prevent part of the car 2 from contacting the guide rail.

In the first embodiment of the present invention shown in FIGS. 1 and 2, other advantageous effects, obtained by deviating the axis of suspension of the car from the center of gravity position, will now be described.

In conventional elevator devices of the type in which the axis 0 of suspension of the car generally coincides with the position W of the center of gravity of the car, so that the interval B between the axis S of suspension of the counterweight 10 and the position W of the center of gravity of the car 2 is greater than the diameter C of the sheave 12 (the relation between the center of gravity position of the car and the axis of suspension of the counterweight is usually established in this manner), the interval between the axis 0 of suspension of the car 2 and the axis S of suspension of the counterweight 10 is greater than the diameter C of the sheave 12, so that the car 2 will impinge upon the counterweight 10. To avoid this, the hoisting device comprises a deflector wheel for increasing the interval between the opposed straight portions of the rope.

On the other hand, in the embodiment of the present invention, the axis 0 of suspension of the car 2 is disposed closer to the axis S of suspension of the counterweight 10, and the deflected load produced by this arrangement is canceled by the anti-deflected load generating device, and the interval between the suspension axes O and S can be made generally equal to the diameter C of the sheave 12. Therefore, a deflector wheel is not needed, and the space for installing the hoisting device can be made small.

In the embodiment of the present invention, by obviating the need for a deflector wheel as described above, the angle (lap angle) of contact of the rope 8 around the sheave 12 is increased, and therefore a slip of the rope 8 relative to the sheave 12 is reduced, thereby increasing a lifetime of the rope 8. Also, even in the case where the car 2 is made more lightweight, the car of the elevator can be started and stopped without causing the rope to slip.

In the above first embodiment of the invention, although the anti-deflected load generating device is constituted by the electromagnet 14, a permanent magnet 28 may be incorporated in the magnetic path of the electromagnet 14 (the anti-deflected load generating device) so that the attraction force of this permanent magnet can undertake part of the canceling of the deflected load component. By doing so, the magnetomotive force of a coil 30 of the electromagnet 14 is reduced, and the attraction force of the electromagnet 14 can be controlled.

In the present invention, the deflected load component can be reduced even if the anti-deflected load generating device is constituted entirely of a permanent magnet. However, in this case, the attraction force can not be controlled, and therefore a stopper for preventing the permanent magnet from contacting the guide rail needs to be mounted on the arm 22*b*.

The attraction force of the electromagnet 14 can be controlled by a signal from a load gauge for detecting the spring force of the roller support spring or a signal from a displacement gauge for detecting the flexure of this spring. By doing so, a uniform control of the guide loads acting on the rollers 24*a* and 24*b* can be effected.

The deflected load component, produced by the deviation of the suspension axis of the car 2 from its center of gravity position, hardly varies during the running of the elevator. On the other hand, lateral vibration components during the running of the elevator are contained in the signal from the above-mentioned load gauge or displacement gauge for controlling the electromagnet 14. Therefore, these components are removed from the signal by a low-pass filter or the like, and thereafter the signal is used for controlling the attraction force of th electromagnet 14.

Figure 5:
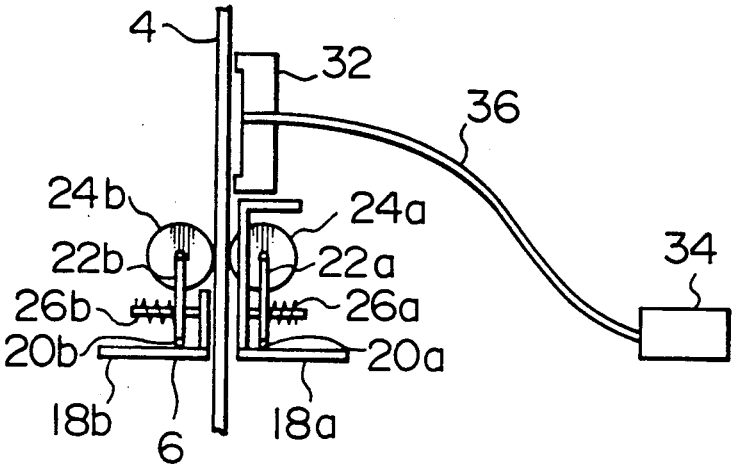
FIG. 5 is a side elevational view showing a modified form of anti-deflected load generating device of the invention.

FIG. 5 shows a modified form of anti-deflected load generating device of the invention.

In FIG. 5, as described above for FIG. 3, a guide device 6 guides a car 2 in such a manner that a guide load on a roller 24*a* is greater than a guide load on a roller 24*b*.

In the anti-deflected load generating device shown in FIG. 5, a pneumatic bearing 32 mounted on a base 18*a* acts on one side surface of a guide rail 4 disposed in contact with the roller 24*a*, and air pressure is supplied to the pneumatic bearing 32 via an air source controller 34 and a pipe 36, and this pressure is controlled in accordance with spring forces or flexures of roller support springs 26*a* and 26*b*. With this arrangement, also, the deflected load component acting on the roller 24*a* can be reduced, and similar effects as described above for the preceding embodiment can be achieved.

In the above embodiments, although the guide devices of the roller guide type are used, the present invention can also be applied to guide devices of the slide type.

Figure 6:
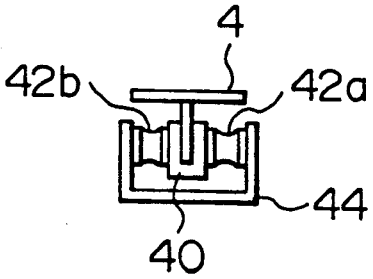
FIGS. 6 and 7 are views showing another modified form of an anti-deflected load generating device used in a guide device of the slide type.
Figure 7:
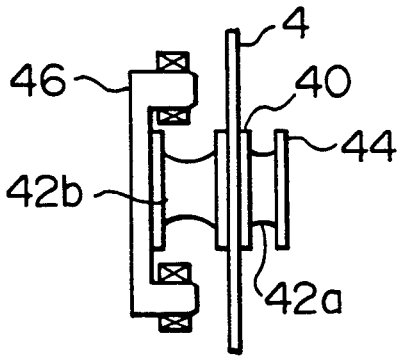

FIGS. 6 and 7 shows an anti-deflected load generating device incorporated in a guide device of the slide type according to the present invention. In this case, as in the guide device of the roller guide type, a deflected load component acting on a side surface of a guide rail can be controlled.

In FIG. 6, a slide type guide member 40 engaged with the guide rail 4 is fixed to a frame 44 through rubber members (resilient guide members) 42*a* and 42*b*, and the frame 44 constitutes the guide device of the slide type mounted on a car 2.

In this guide device of the slide type, an electromagnet 46 mounted on the frame 44 as shown in FIG. 7 constitutes the anti-deflected load generating device, and therefore similar effects as described for the above embodiments can be achieved.

Figure 8:
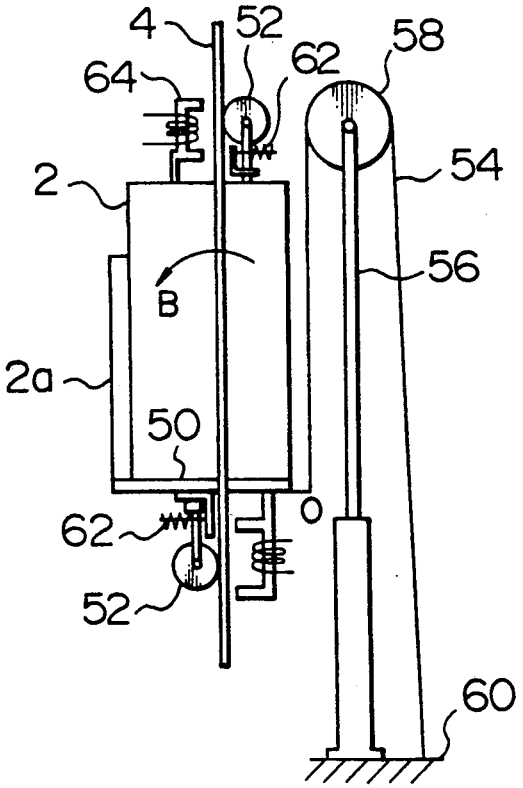
FIG. 8 is a side elevational view of a second embodiment of the present invention.

FIG. 8 shows a second embodiment of the present invention.

In this second embodiment, the axis of suspension of a car is deviated to such an extent that a guide load of a guide device is disposed on one side of a guide rail.

In this embodiment, the axis O of suspension of the car 2 is disposed outside of a floor 50 of the car 2. A rope 54, connected between the suspension axis 0 and a building foundation 60, supports the car 2 through a deflector wheel 58 mounted on a distal end of a hydraulic plunger 56, and the car 2 is driven by the hydraulic plunger 56.

In such a typical hydraulic elevator of the back plunger type, since the suspension axis 0 of the car 2 is disposed outside of the floor 50, the guide load acting on the guide device 6 acts only on one side surface of the guide rail 4 regardless of the distribution of a live load in the car 2.

Therefore, generally, in this type of elevator apparatus, a large guide load acts on a roller 52 of the guide device 6, and therefore a support spring 62 for this roller is required to have a high rigidity, and the car 2 is susceptible to vibration under the influence of a bending of the guide rail and an irregularity in the shape of the roller 52.

The present invention can also be applied to such a roping-type elevator apparatus in which the car is suspended by the rope. More specifically, electromagnets 64 constituting anti-deflected load generating devices are mounted respectively on the upper and lower portions of the car 2. Each of the electromagnets 64 serves to reduce the guide load acting in one direction, and reduces a strain due to a creep of the roller 52. The anti-deflected load generating device can be similar in construction to any of the above-mentioned types, and by doing so, the comfort of a ride can be improved.

In the above embodiments of the invention, although the suspension axis of the car is deviated from the position of the center of gravity of the car in the direction perpendicular to the plane of the entrance/exit of the car, the suspension axis may be deviated from the center of gravity position in a direction parallel to the plane of the entrance-exit of the car.

As described above, the suspension axis of the car is deviated from the position of the center of gravity of the car, and the deflected load component of the guide load acting on the guide device for the car can be reduced by the anti-deflected load generating device. Therefore, the guide device does not need to directly bear the deflected load, and the spring constant of the support spring for the guide member of the guide device can be reduced. As a result, vibration due to a bending of the guide rail can be reduced.

The guide load acting in the direction perpendicular to the plane of the guide rail is designed to produce the deflected load acting on the guide rail in one direction, and therefore the number of the antideflected load generating devices can be reduced to a half of the number heretofore required, and therefore the manufacturing cost of the elevator apparatus can be reduced.

Since the provision of the anti-deflected load generating devices allows the deviation of the suspension axis of the car, the interval between the suspension axis of the car and the suspension axis of the counterweight can be made generally equal to the diameter of the sheave of the hoisting device, and with this arrangement, the hoisting device can be of a compact size. Also, since the lap angle of the sheave is about 180°, a sufficient hoisting force can be ensured even if the tension of the rope is small, and therefore the car can be lightweight.

In the roping of the hydraulic elevator apparatus of the back plunger type in which the deflected load of the guide device acts only in one direction, the guide load of the guide device is large; however, by the use of the anti-deflected load generating device of the present invention, this guide load can be reduced, and therefore a comfortable ride can be provided for the hydraulic elevator apparatus.

Further, in the present invention, a bending of the guide rail can be allowed to a certain extent, and therefore the installation of the guide rail can be facilitated.

What is claimed is:

1. An elevator apparatus comprising a car, a pair of guide rails, and guide devices mounted respectively on upper and lower portions of said car, said guide devices having guide members engaged with said guide rails so as to guide said car along said guide rails in a manner to hold said car in a proper position;

wherein each guide device of said guide devices comprises a resilient support member having a small spring constant supporting a guide member of said guide device in such a manner that said guide member is movable in a direction perpendicular to a plane of a guide rail engaged by said guide member;

wherein said elevator apparatus further comprises deflected load generating means for causing, independent of a bend in said guide rail, a guide load, acting on a side surface of said guide rail via said guide member in a direction perpendicular to the plane of said guide rail, to include a deflected load acting on said guide rail in only one direction at all times; and wherein said guide device further comprises an anti-deflected load generating device for generating an anti-deflected load in a direction to reduce the deflected load of the guide load caused by said deflected load generating means, the anti-deflected load generating device being disposed between said car and said guide rail.

2. An elevator apparatus according to claim 1, in which said deflected load generating means comprises means for producing a tilting moment in said car, and said anti-deflected load generating device comprises means for producing an anti-tilting moment for reducing said tilting moment.

3. An elevator apparatus according to claim 1, in which said anti-deflected load generating device comprises a magnet for attracting said guide rail.

4. In an elevator apparatus comprising a car, a pair of guide rails, and guide devices mounted respectively on upper and lower portions of said car, said guide devices having guide members engaged with said guide rails so as to guide said car along said guide rails in a manner to hold said car in a proper posture;

the improvement wherein each of said guide devices comprises a resilient support member of a small spring constant supporting said guide member in such a manner that said guide member is movable in a direction perpendicular to a plane of said guide rail; deflected load generating means for causing a guide load, acting on a side surface of said guide rail via guide member in a direction perpendicular to the plane of said guide rail, to have a deflected load acting on said guide rail in one direction; and an anti-deflected load generating device for generating an anti-deflected load in a direction to reduce a deflected load component of the guide load produced by said deflected load generating means, the anti-deflected load generating device being disposed between said car and said guide rail, in which said anti-deflected load generating device comprises a pneumatic bearing for applying a repulsive force to said guide rail.

5. An elevator apparatus according to claim 3, in which said magnet for attracting said guide rail comprises an electromagnet, and a permanent magnet incorporated in a magnetic path of said electromagnet.

6. An elevator apparatus according to claim 1, in which said anti-deflected load generating device comprises a permanent magnet for always attracting said guide rail.

7. An elevator apparatus according to claim 3, in which said magnet for attracting said guide rail comprises an electromagnet, an electromagnetic force of said electromagnet being controlled by one of a spring force of said resilient support member and a flexure of said resilient support member.

8. An elevator apparatus comprising a car, a pair of guide rails, and guide devices mounted respectively on upper and lower portions of said car, said guide devices having guide members engaged with said guide rails so as to guide said car along said guide rails in a manner to hold sid car in a proper position;

wherein each guide device of said guide devices comprises a resilient support member having a small spring constant supporting a guide member of said guide device in such a manner that said guide member is movable in a direction perpendicular to a plane of a guide rail engaged by said guide member;

wherein an axis of suspension of said car is deviated from a position of a center of gravity of said car so as to cause, independent of a bend in said guide rail, a guide load, acting on a side surface of said guide rail via said guide member in a direction perpendicular to the plane of said guide rail, to include a deflected load acting on said guide rail in only direction at all times; and wherein said guide device further comprises an anti-deflected load generating device for generating an anti-deflected load in a direction to reduce the deflected load of the guide load caused by the deviation of the axis of suspension of said car from the position of the center of gravity of said car, the anti-deflected load generating device being disposed between said car and said guide rail.

9. An elevator apparatus according to claim 8, in which said anti-deflected load generating device comprises a magnet for attracting said guide rail.

10. An elevator apparatus according to claim 8, in which said anti-deflected load generating device comprises a pneumatic bearing for applying a repulsive force to said guide rail.

11. An elevator apparatus according to claim 9, in which said magnet for attracting said guide rail comprises an electromagnet, and a permanent magnet incorporated in a magnetic path of said electromagnet.

12. An elevator apparatus according to claim 8, in which said anti-deflected load generating device comprises a permanent magnet for always attracting said guide rail.

13. An elevator apparatus according to claim 9, in which said magnet for attracting said guide rail comprises an electromagnet, an electromagnetic force of said electromagnet being controlled by one of a spring force of said resilient support member and a flexure of said resilient support member.

14. An elevator apparatus comprising a car, a pair of guide rails, guide devices mounted respectively on upper and lower portions of said car, sid guide devices having guide members engaged with si guide rails so as to guide said car along said guide rails in a manner to hold said car in a proper position, a counterweight for said car, and a hoisting device having a sheave for driving said car and sid counterweight through a rope;

wherein each guide member of said guide devices comprises a resilient support member having a small spring constant supporting a guide member of said guide device in such a manner that said guide member is movable in a direction perpendicular to a plane of a guide rail engaged by said guide member;

wherein an axis of suspension of said car is deviated from a position of a center of gravity of said car in such a manner that an interval between the axis of suspension of said car and an axis of suspension of said counterweight is substantially equal to a diameter of said sheave, so as to cause, independent of a bend in said guide rail, a guide load, coating on a side surface of said guide rail valid said guide member in a direction perpendicular to the plane of said guide rail, to include a deflected load acting on said guide rail in only one direction at all times; and wherein said guide device further comprises an anti-deflected load generating device for generating an anti-deflected load in a direction to reduce the deflected load of the guide load caused by the deviation of the axis of suspension of said car from the position of the center of gravity of said car, the anti-deflected load generating device being disposed between said car and said guide rail.

15. A hydraulic elevator apparatus comprising a car, a pair of guide rails, guide devices mounted respectively on upper and lower portions of said car, said guide devices having guide members engaged with sid guide rails so as to guide said car along said guide rails in a manner to hold said car in a proper position, and a hydraulic jack for driving said car through a rope;

wherein each guide device of said guide devices comprises a resilient support member having a small spring constant supporting a guide member of said guide device in such a manner that said guide member is movable in a direction perpendicular to a plane of a guide engaged by said guide member;

wherein said car is suspended by said rope at a position rearward of a rear of said car, so as to cause, independent of a bend in said guide rail, a guide load, acting on a side surface of said guide rail via said guide member in a direction perpendicular to the plane of said guide rail, to include a deflected load acting on said guide rail in only one direction at all times; and wherein said guide device further comprises an anti-deflected load generating device for generating an anti-deflected load in a direction to reduce the deflected load of the guide load caused by the suspension of said car at the position rearward of the rear of said car, the anti-deflected load generating device being disposed between said car and said guide rail.

16. An elevator apparatus according to claim 1, in which said anti-deflected load generating device comprises a pneumatic bearing for applying a repulsive force to said guide rail.

* * * * *